US007229670B2

(12) United States Patent
Williams

(10) Patent No.: US 7,229,670 B2
(45) Date of Patent: Jun. 12, 2007

(54) METHOD OF MAKING A GLOVE WITH GRIPPING DOTS

(76) Inventor: Cole Williams, 8475 NE. County Park Rd., Bainbridge Island, WA (US) 98110

( * ) Notice: Subject to any disclaimer, the term of this patent is extended or adjusted under 35 U.S.C. 154(b) by 0 days.

(21) Appl. No.: 11/187,092

(22) Filed: Jul. 22, 2005

(65) Prior Publication Data

US 2007/0031601 A1 Feb. 8, 2007

(51) Int. Cl.

| | |
|---|---|
| ***B05D 1/32*** | (2006.01) |
| ***B05D 1/38*** | (2006.01) |
| ***B05D 3/00*** | (2006.01) |
| ***B05D 3/06*** | (2006.01) |
| *A41D 19/00* | (2006.01) |

(52) U.S. Cl. ..... 427/282; 427/510; 427/513; 427/514; 427/288; 427/389.9

(58) Field of Classification Search ..... 427/487, 427/510, 513, 514, 541, 209, 210, 256, 282, 427/288, 372.2, 384, 389.9, 394; 2/159, 2/161.3, 161.6, 161.8, 167, 168, 907
See application file for complete search history.

(56) References Cited

U.S. PATENT DOCUMENTS

| | | | | |
|---|---|---|---|---|
| 3,934,062 | A * | 1/1976 | Tillotson et al. | 427/185 |
| 4,259,377 | A * | 3/1981 | Baize | 427/346 |
| 6,912,731 | B2 * | 7/2005 | Cass | 2/161.1 |
| 2004/0199978 | A1 * | 10/2004 | Cass | 2/161.3 |

* cited by examiner

*Primary Examiner*—William Phillip Fletcher, III
(74) *Attorney, Agent, or Firm*—James E. Brunton, Esq.

(57) ABSTRACT

A stretchable glove and the method of making the glove that stabilizes the interior of the glove with the skin of the user and enables the user to deftly grip and manipulate various types of articles. Uniquely, the glove is provided with a multiplicity of gripping dots on both the inside and outside surfaces of the glove. The gripping dots are strategically spaced in a manner so that the stretch quality of the glove is not restricted. The method of making the glove includes the steps of forming a generally hand-shaped glove, depositing a multiplicity of dots of a polymer emulsion on selected portions of one surface of the glove, curing the polymer emulsion, turning the glove inside-out, depositing a multiplicity of dots of a polymer emulsion on selected portions of the other side of the glove and curing the polymer emulsion thusly deposited.

20 Claims, 9 Drawing Sheets

METHOD OF MAKING A GLOVE WITH GRIPPING DOTS

BACKGROUND OF THE INVENTION

1. Field of the Invention

The present invention relates generally to gloves and methods for making same. More particularly, the invention concerns an improved glove having a friction-gripping surface consisting of a multiplicity of closely positioned gripping dots provided on both the exterior and interior surfaces thereof and a novel method of making the glove.

2. Discussion of the Prior Art

Light weight gloves are used for many work-related and recreational purposes such as gardening, operation of various tools, driving, shooting, playing ball, motorcycling and a wide variety of outdoor activities. Frequently such gloves have been made from leather and several different types of treated, relatively hard surfaced fabrics. Attempts have also been made in the past to produce stretchable knitted gloves that are comfortable to wear, will protect the wearer's hands and at the same time will permit the user to securely grip and efficiently manipulate various types of articles. Usually gloves, whether cut to a pattern and assembled by sewing or knit in one piece have been made such that the interior surfaces are smooth, soft, comfortable and cozy feeling. Such gloves, with the soft, smooth interior surfaces and with aggressive tenacious gripping surfaces on the outside, are not stable relative to the wearer's skin. After performing a task that involves the secure gripping of the article being held, the glove typically must be pulled back on or adjusted relative to the hand. While grip dots have been commonly used on prior art gloves, the dots have been used only on the outside surfaces of the gloves.

SUMMARY OF THE INVENTION

It is an object of the present invention to provide an improved stretchable glove that is lightweight and closely conforming to the shape of the users hand and one which provides superior grip characteristics.

Another object of the invention is to provide a stretchable glove of the aforementioned character and the method of making the glove wherein the glove is provided with a multiplicity of gripping dots spaced such that the stretch quality of the glove is not restricted by the excessive coverage of the knit fabric by the grip dots.

Another object of the invention is to provide a glove that stabilizes the interior of the glove with the skin of the wearer.

Another object of the invention is to provide a glove of the aforementioned character and the method of making the glove wherein the glove is provided with a multiplicity of gripping dots on both the exterior and interior surfaces of the glove that enable the user to securely grip and readily manipulate various types of articles.

Another object of the invention is to provide a glove of the aforementioned character that exhibits a high degree of comfort and durability in use.

A particular object of the invention is to provide a glove of the character described that is highly versatile and durable in use and one which enables the user to deftly manipulate various objects.

Another object of the invention is to provide a method of making a glove of the character described in the preceding paragraphs which is simple and straightforward, does not require the use of complicated equipment such as sewing and seaming equipment and can be performed by unskilled workmen with a minimum of training.

In summary, one form of the method of the invention for making the knit gripping glove of the invention comprises the steps of using a combination of synthetic yarn that incorporates elastic filaments to knit a precursor glove that closely conforms to the shape of the user's hand and then first placing the precursor glove over a generally hand-shaped mandrel to form a stretched precursor glove that is stretched approximately 20 to 30 percent. Next, a multiplicity of closely-spaced small dots of a liquid vinyl material are deposited on the palm surface of the stretched precursor to form a coated precursor glove. Thereafter, the cured precursor assembly is removed from the hand-shaped mandrel and reversed, that is, turned inside-out and once again stretched over the hand-shaped mandrel, to form an inside-out stretched precursor glove that is once again stretched to on the order of 20 to 30 percent. This done, a multiplicity of closely-spaced small dots of a liquid vinyl material are deposited on the inside of the palm surface of the reversed stretched precursor to form an inside coating on the precursor glove which is then cured. This cured precursor assembly is removed from the generally hand-shaped mandrel permitting the precursor assembly to shrink and in so doing causing the multiplicity of vinyl gripping protuberances to move closer together. Finally, the cured glove with grip dots both inside and outside is reversed to its right-side-out condition.

BRIEF DESCRIPTION OF THE DRAWINGS

FIG. 10 also shows the alternate form of the stencil component of the apparatus of the invention superimposed over the second, uncoated surface of the glove.

DISCUSSION OF THE INVENTION

Figures 1, 2:
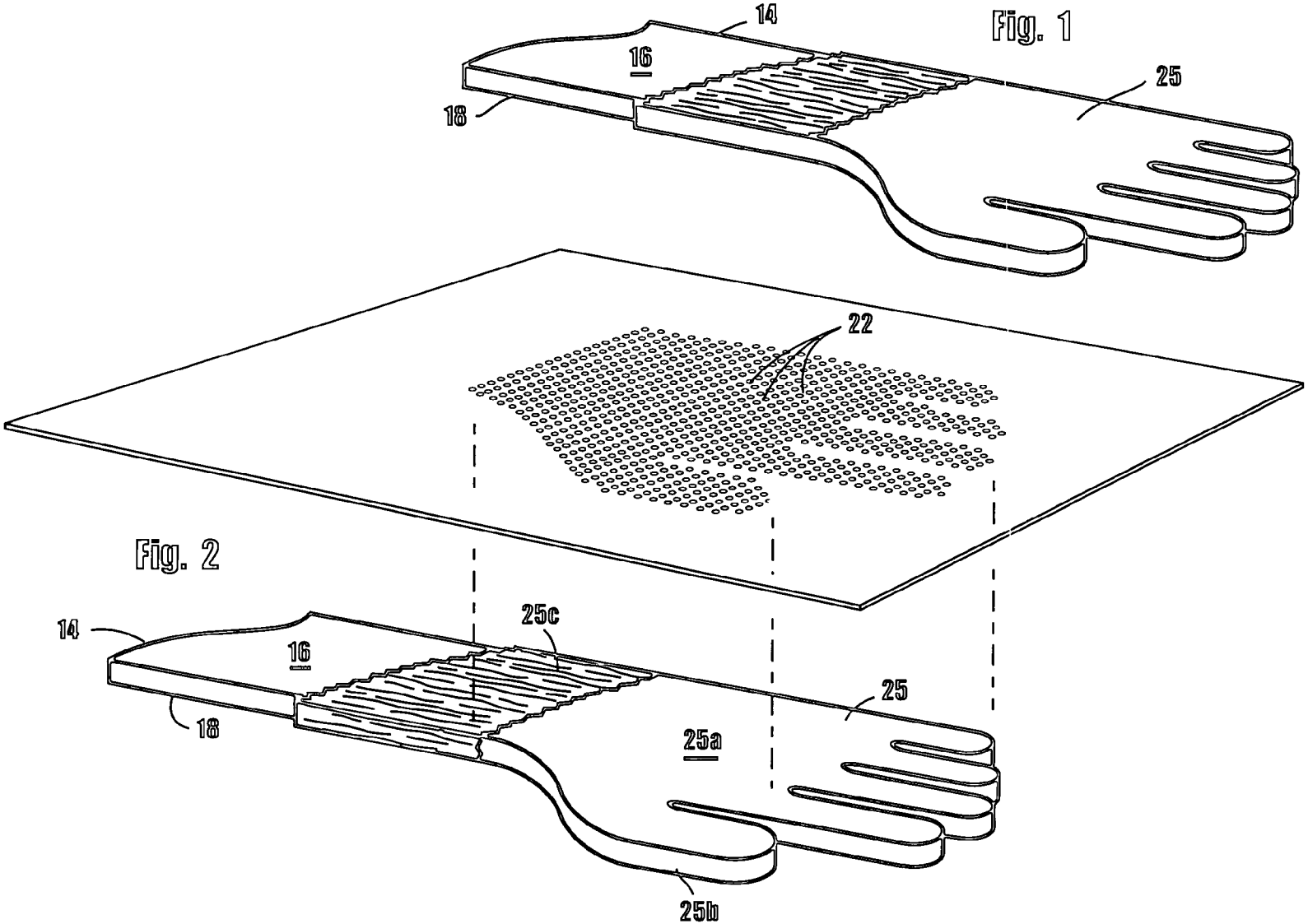
FIG. 1 is a generally perspective view showing a glove emplaced over the generally glove-shaped mandrel of the apparatus of the invention.
FIG. 2 is a generally perspective, exploded view showing the generally hand-shaped stencil component of the apparatus of the invention superimposed over the first, outer surface of assemblage shown in FIG. 1.

Referring to the drawings and particularly to FIGS. 1 through 7, one form of the apparatus of the invention for making a glove having gripping surfaces thereon is there shown. In the present form of the invention, the apparatus comprises a substantially rigid, aluminum mandrel 14 which has the general shape of a human hand, but is somewhat larger than the size of a normal human hand. Mandrel 14 has a first, generally planar surface 16 and a second, spaced-apart generally planar, opposing surface 18.

Also forming a part of the apparatus of the present invention is a generally hand-shaped, substantially rigid stencil component 20 that has generally planar, spaced-apart opposing surfaces 20*a* and 20*b* and is provided with a multiplicity of spaced-apart generally dot size apertures 22 therethrough.

Figure 3:
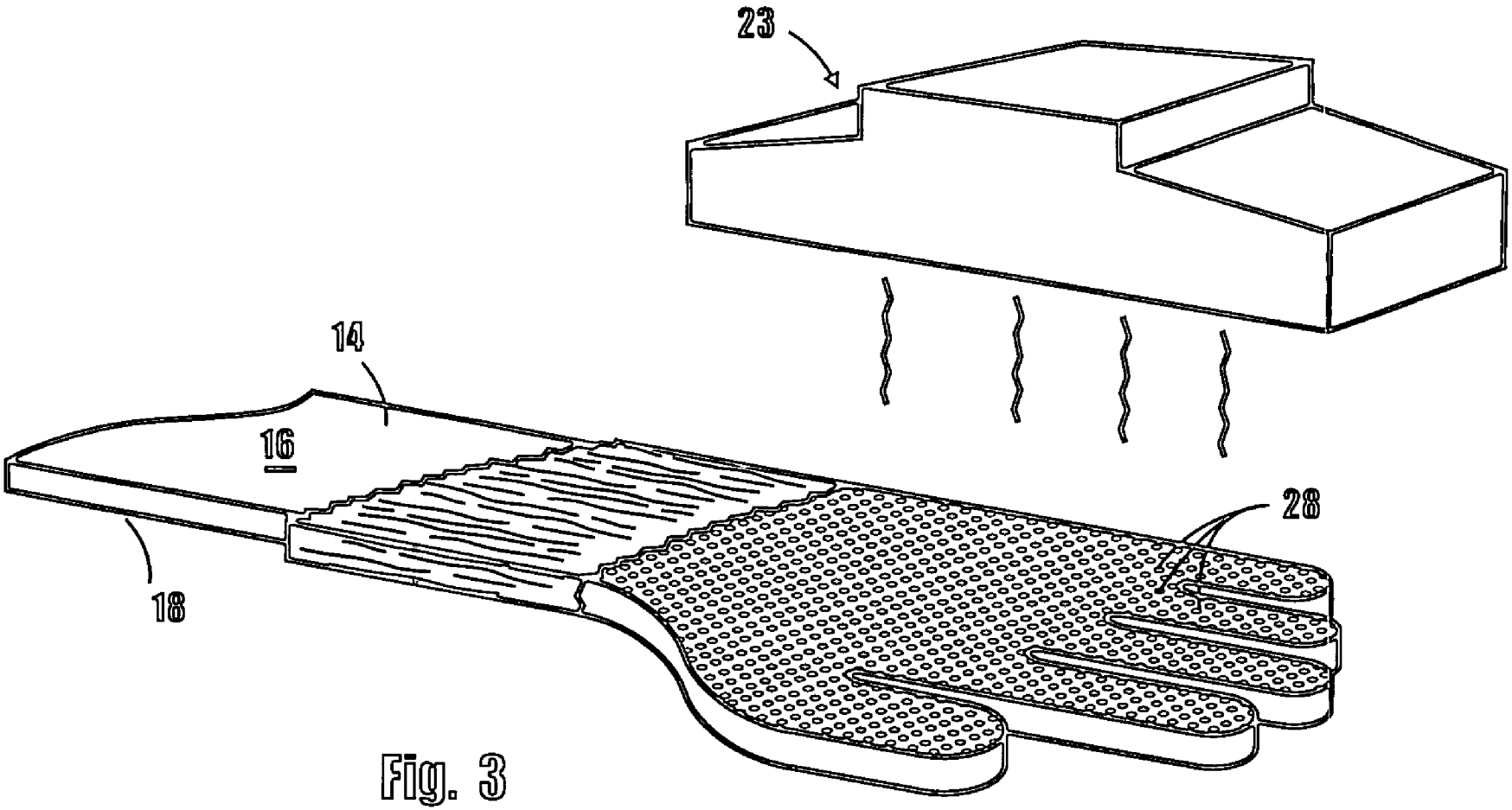
FIG. 3 is a generally perspective, diagrammatic view showing the curing or irradiation means of the apparatus of the invention superimposed over the assemblage of FIG. 1 as it appears following the deposition of a multiplicity of gripping dots on the first, outer surface of the glove.
Figure 4:
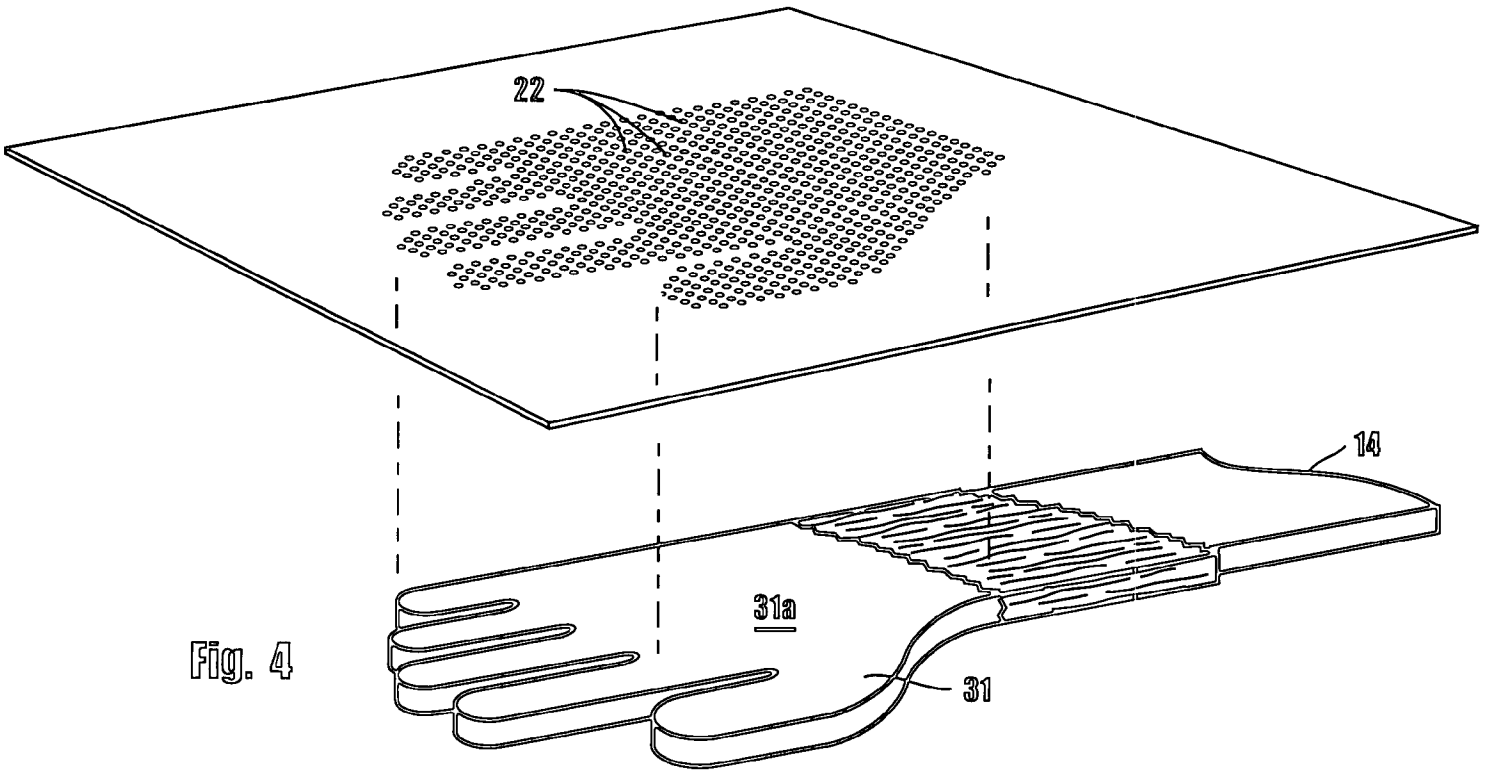
FIG. 4 is a generally perspective view, similar to FIG. 2, but showing the assemblage illustrated in the lower portion of FIG. 3 as it appears when turned inside-out to expose the second, uncoated surface of the glove and also showing the stencil component of the apparatus of the invention superimposed over the second, uncoated surface of the glove.
Figure 5:
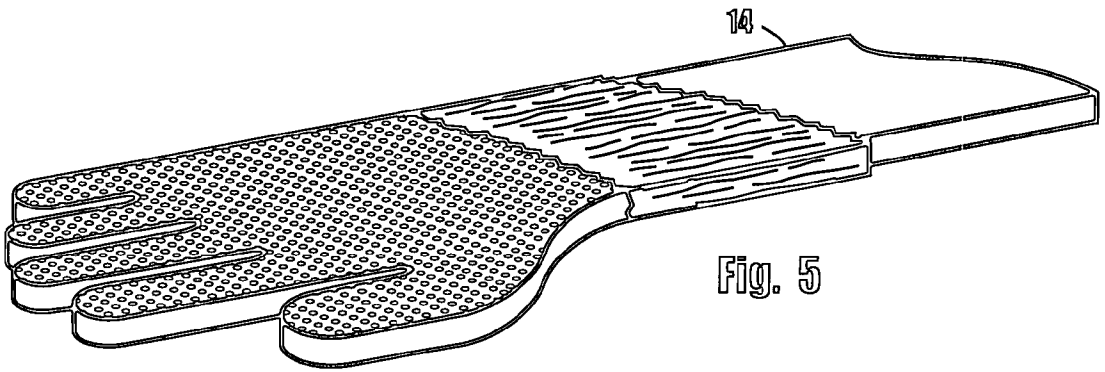
FIG. 5 is a generally perspective view of the glove mandrel assembly shown in the lower portion of FIG. 4 as it appears following the deposition of a multiplicity of gripping dots on the second surface of the stretchable glove.
Figure 6:
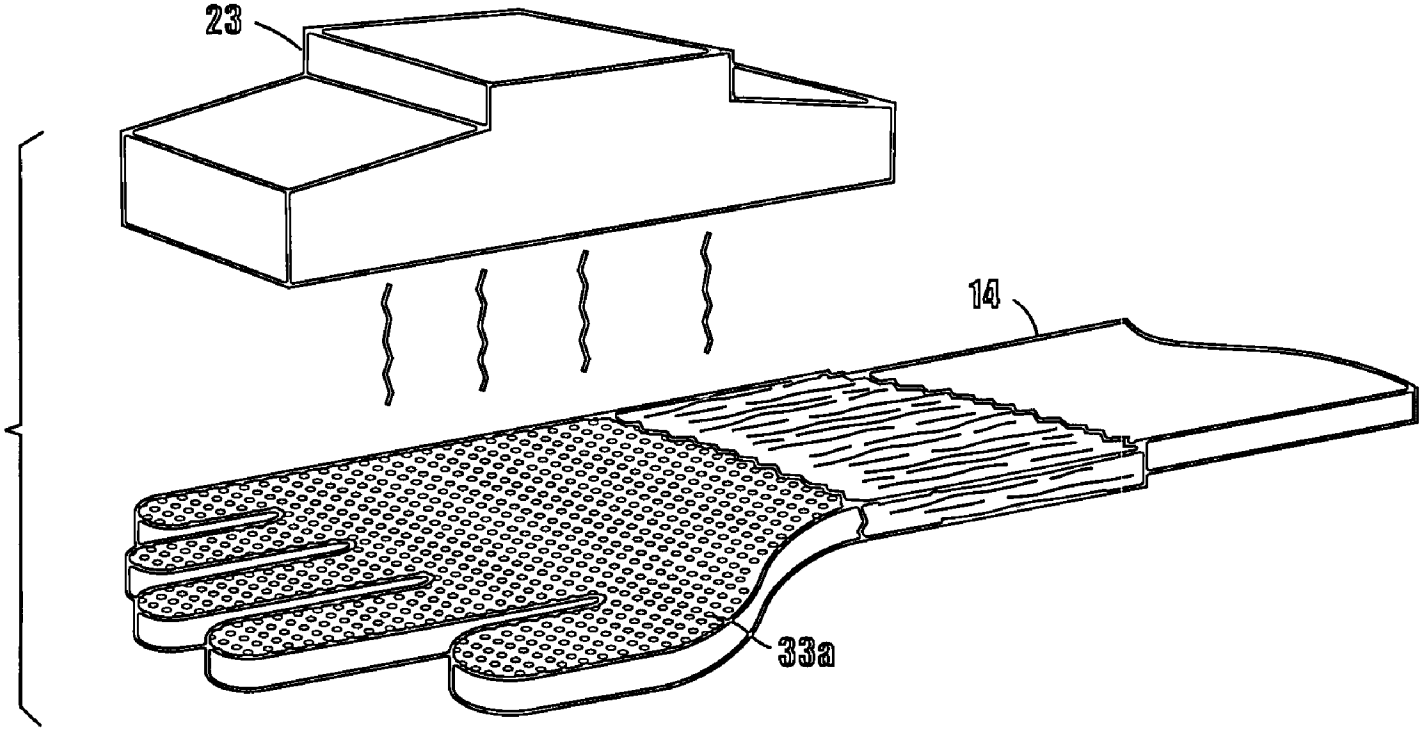
FIG. 6 is a generally perspective view, similar to FIG. 3, but showing the irradiation means of the apparatus of the invention superimposed over the second, coated surface of the glove.

Turning to FIG. 3, it can be seen that the apparatus of the invention also includes curing or irradiation means, generally designated by the numeral 23, for irradiating the precursor assemblies of the invention. The character of this important means will presently be described.

Consider now one form of the method of the invention for making a stretchable gripping glove having a multiplicity of gripping surfaces. The form of the method here described comprises the steps illustrated in the drawings and discussed in the paragraphs which follow. The first step in the method of the invention is to knit, in a conventional manner well understood by those skilled in the art, a stretchable glove, which is generally designated in FIG. 1 by the numeral 25. Glove 25 is preferably knitted using a spun yarn sold by Pharma Yarns, Inc of McAdenville, N.C. This novel spun yarn comprises stretchable fibers, such as fibers sold by Invista, Inc. of Wichita, Kans. under the name and style LYCRA.

The next step in the method of the invention is to place the knitted glove 25 over the form 14 in the manner shown in FIG. 1 of the drawings. Because the knitted glove is smaller in size than the form 14, the glove will be stretched to form a stretched glove having first and second generally planar, opposing palm and back surfaces 25*a* and 25*b* and an elastic cuff portion 25*c* (see FIG. 2).

With the stretched glove in position over the form 14, the next step in the method of the invention is to superimpose the stencil 20 over the first surface 25*a* of said stretched glove in the manner illustrated in FIG. 2. With the stencil 20 indexedly aligned and in engagement with the first surface 25*a* of the stretched glove, a multiplicity of dots 28 of a polymer emulsion, such as a liquid vinyl emulsion, are deposited on the first surface 25*a* (see FIGS. 2 and 3) of the stretched glove by forcing the emulsion through the apertures 22 that extend through the stencil to form an uncured first precursor 31 (See FIG. 4). After the polymer emulsion is forced through the apertures 22 through the use of a squeegee or any other suitable like instrumentality, the dots 28 that are thusly formed are converted from a paste-like consistency into a rubber-like consistency and are bonded to the surface 25*a*. In order that the stretchability of the glove is not adversely affected, the area of coverage of the dots needs to be controlled. Experience has shown that in order to maintain proper stretchability the gripping dots should cover no more than about 25% of the fabric area. Accordingly, the apertures 22 formed in the stencil should not cover an area greater than 25% of the surface of the stretched glove upon which the dots are to be applied.

Following the dot formation step to form the uncured first precursor 31, the polymer dots, such as the vinyl dots 28, are suitably cured. This curing (fusing or conversion) of the dots may be done by exposing the uncured dots to a suitable radiation such as that is emitted from the radiation means 23 of the invention (see FIG. 3). The radiation means can comprise either an irradiation device that produces infrared heat or an irradiation device that produces ultra-violet light depending on the formulation of the emulsion. When certain emulsions are used, the radiation means can also comprise a conventional heating means for controllably heating the uncured emulsion. Radiation means, such as means 23, are well known to those skilled in the art and are readily commercially available.

It is to be understood that in practice the uncured first precursor could be positioned on a conveyor belt and passed beneath the irradiation means in a manner to cure the dots 28.

Figure 7:
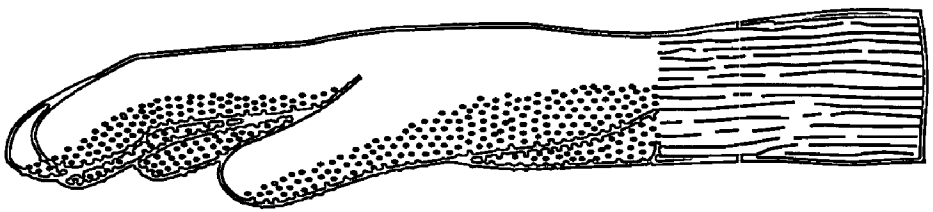
FIG. 7 is a generally perspective view of one form of the glove of the invention having gripping surfaces on both the first and second sides of the glove.

The next step in the method of the invention is to remove the first cured precursor from the mandrel and turn it inside-out to form an inside-out first cured precursor 31. Next, the inside-out first precursor 31 is placed over the mandrel to form an inside-out first precursor having a second, generally planar surface 31*a* (see the lower portion of FIG. 4). This done, the stencil 14 is placed over second generally planar surface 31*a* of the inside-out first cured precursor in the manner shown in FIG. 4. With the stencil 14 indexedly aligned with the planar surface 31*a* a multiplicity of dots of a polymer emulsion are deposited on at least a portion of the surface by forcing the emulsion through the apertures 22 formed in the stencil to form an uncured second precursor 33*a* (see FIG. 6). Next, using curing means 23, the polymer emulsion deposited on the inside-out first cured precursor is suitably cured to form a second cured precursor. Following the curing step, the second cured precursor is removed from the mandrel and once again turned inside-out. The resulting glove, which uniquely has gripping dots on both the inside and outside surfaces of the glove, is depicted in FIG. 7 of the drawings.

Turning now to FIGS. 8 through 14, an alternate form of the method of the invention for making a gripping glove having a multiplicity of gripping surfaces is there shown.

This alternate form of the method is similar in many respects to that described in connection with FIGS. 1 through 7 and like numerals are used to describe like components.

The first step in the alternate form of the method of the invention is to knit, in a conventional manner well understood by those skilled in the art, a glove. Preferably, a thin, stretchable glove, such as that previously described and generally designated in FIG. 8 by the numeral 25.

Figure 8:
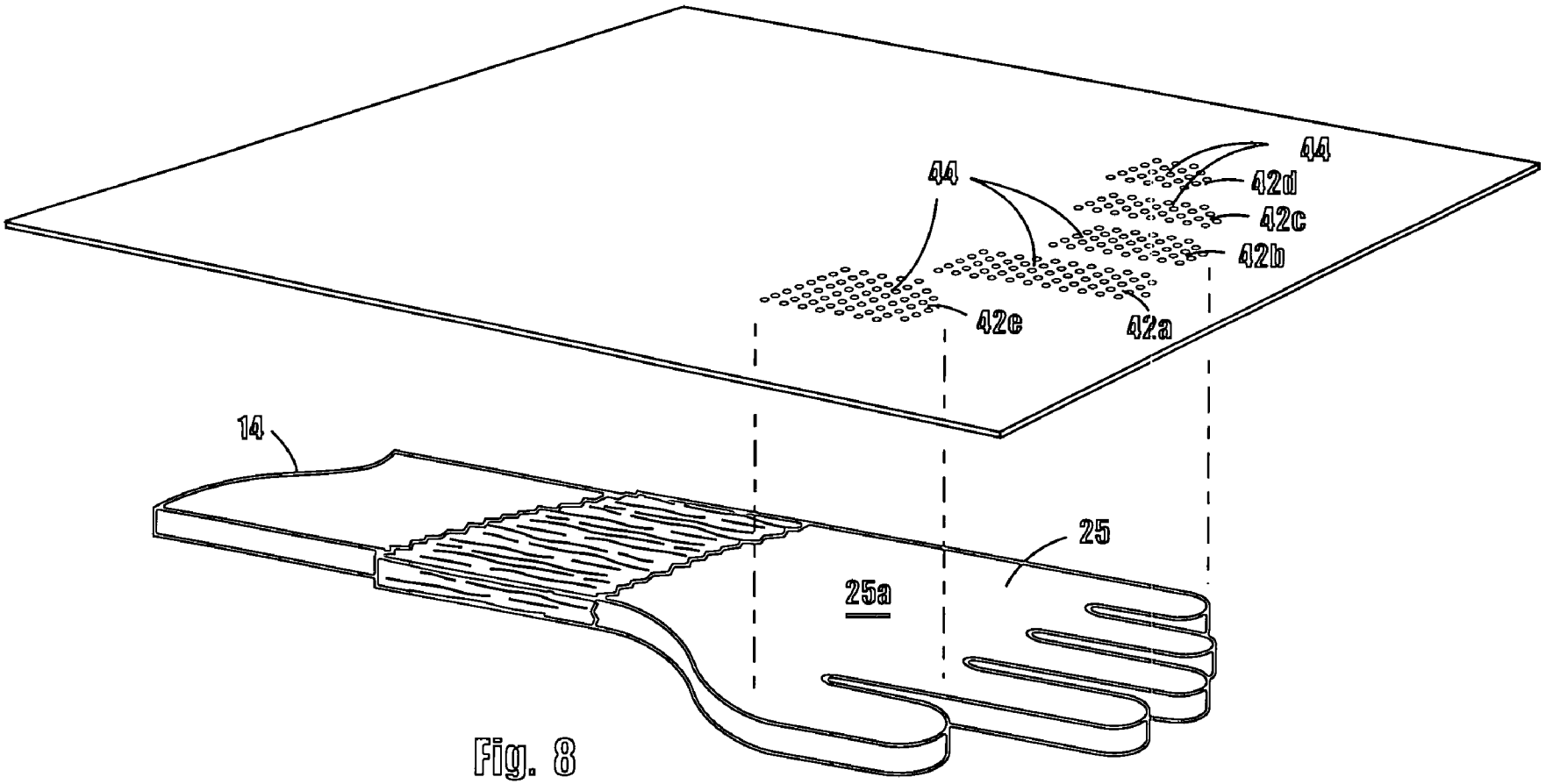
FIG. 8 is a generally perspective, exploded view showing an alternate form the generally hand-shaped stencil component of the apparatus of the invention superimposed over the first, outer surface of assemblage similar to that shown in FIG. 1.
Figure 9:
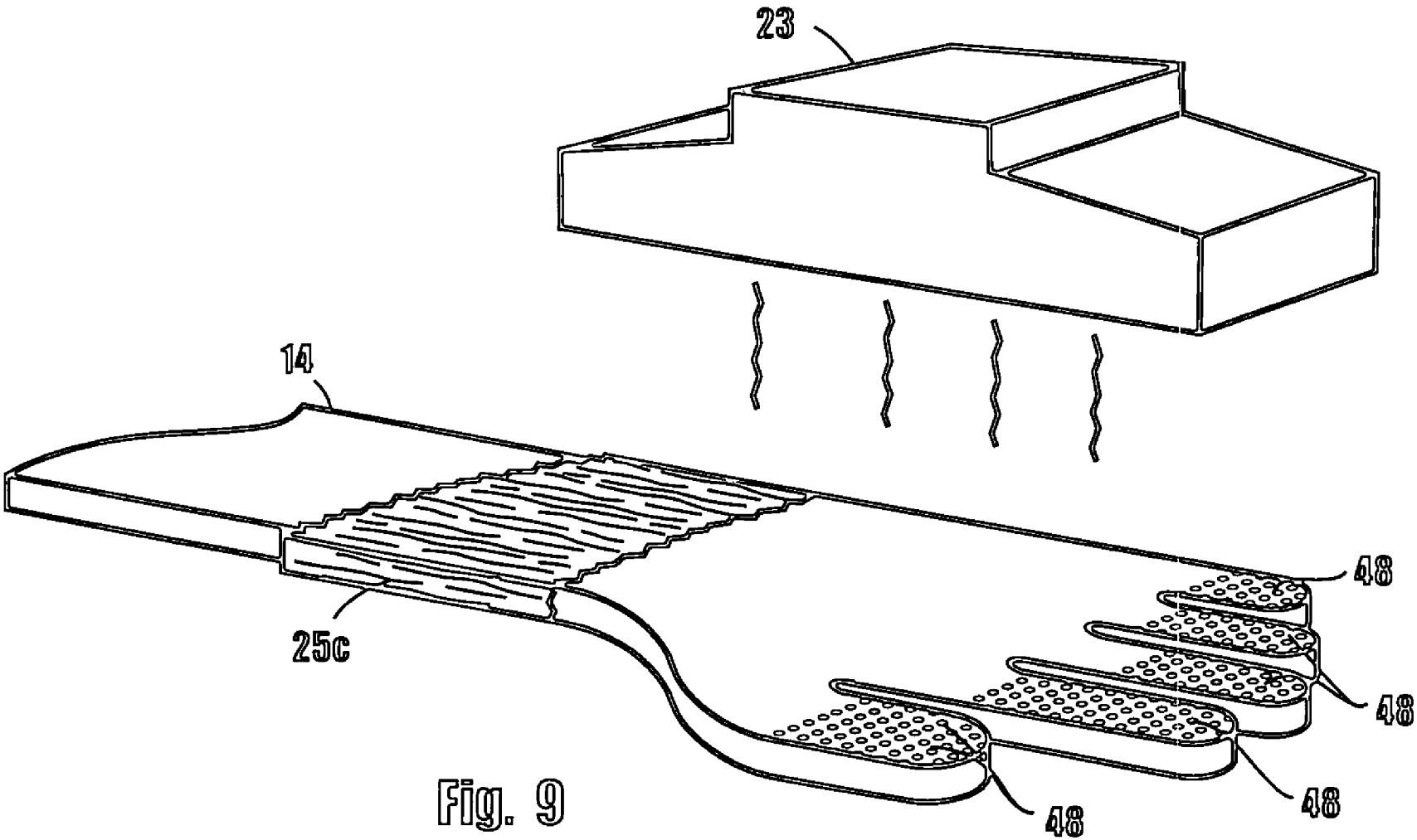
FIG. 9 is a generally perspective, diagrammatic view showing the curing or irradiation means of the apparatus of the invention superimposed over the assemblage of the lower portion of FIG. 8 as it appears following the deposition of a multiplicity of gripping dots on the finger portions of the first, outer surface of the glove.
Figure 10:
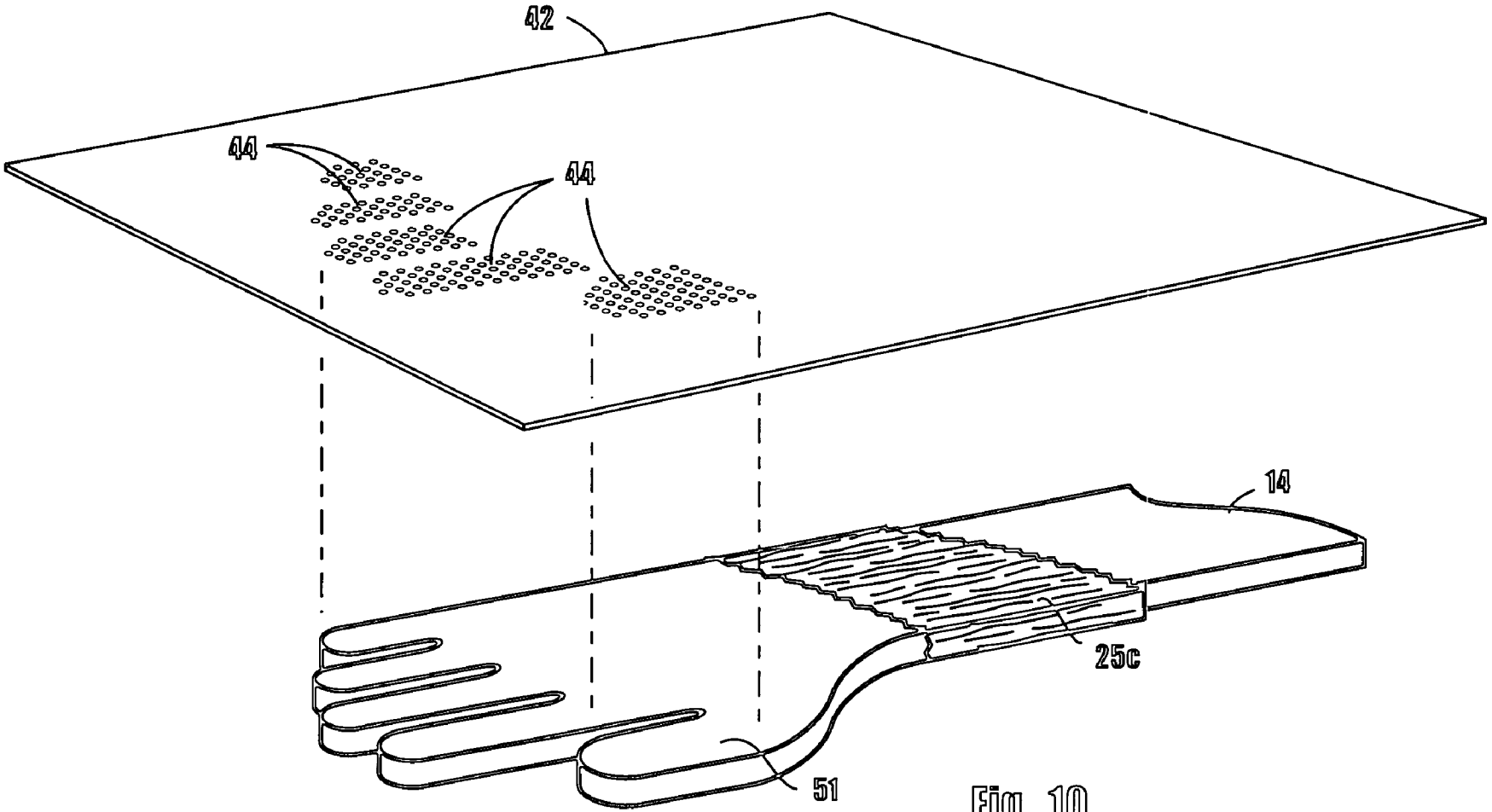
FIG. 10 is a generally perspective view, similar to FIG. 8, but showing the alternate form of the glove shown in FIG. 9 after it has been cured, turned inside-out to expose the second, uncoated surface of the glove and emplaced over the mandrel.

The next step in the method of the invention is to place the knitted glove over the form 14 in the manner shown in FIG. 8 of the drawings. With the stretched glove in position over the form 14, the next step in the alternate form of the method of the invention is to superimpose a differently configured stencil 42 over the first surface 25*a* of said stretched glove in the manner illustrated in FIG. 8. It to be observed that the stencil 42 is of a totally different configuration having a plurality of apertures 44 formed in the four finger-shaped portions 42*a*, 42*b*, 42*c* and 42*d* of the stencil and in the thumb-shaped portion 42*e* of the stencil (finger-shaped portion 42*a* being generally configured like the index or trigger finger of the hand). With the stencil 42 indexedly aligned and in engagement with the first surface 25*a* of the stretched glove, a multiplicity of dots 48 of a polymer emulsion, such as a liquid vinyl (FIG. 9), are deposited on the first surface 25*a* of the stretched glove by forcing the emulsion through the apertures 44 that extend through the stencil to form an uncured first precursor. After the polymer emulsion is forced through the apertures 44 through the use of a squeegee or any other suitable like instrumentality, the dots 48 that are thusly formed are converted from a paste-like consistency into a rubber-like consistency and bonded to the surface 25*a*.

Following the dot formation step to form the uncured first finger dot precursor, the polymer dots, such as the liquid vinyl dots 48, are suitably cured. This curing (fusing or conversion) of the dots is accomplished in the same manner as described in connection with the first embodiment of the method of the invention using an identical irradiation device 23.

The next step in the method of the invention is to turn the first finger dot precursor inside-out to expose the second, uncoated surface 51 of the knit glove. This done, the stencil 42 is also turned over and superimposed over the second surface 51 of said stretched glove in the manner illustrated in FIG. 10. With the stencil indexedly aligned and in engagement with the second surface 51 of the stretched glove, a multiplicity of dots 48*a* of a polymer emulsion, such as a liquid vinyl (FIG. 8) are deposited on the second surface of the stretched glove by forcing a liquid vinyl emulsion through the apertures 44 that extend through the stencil to form an uncured second finger dot precursor. After the liquid vinyl is forced through the apertures 44, the dots 48*a* that are thusly formed are converted from a paste-like consistency into a rubber-like consistency and are bonded to the surface 51 (FIG. 11).

Figure 11:
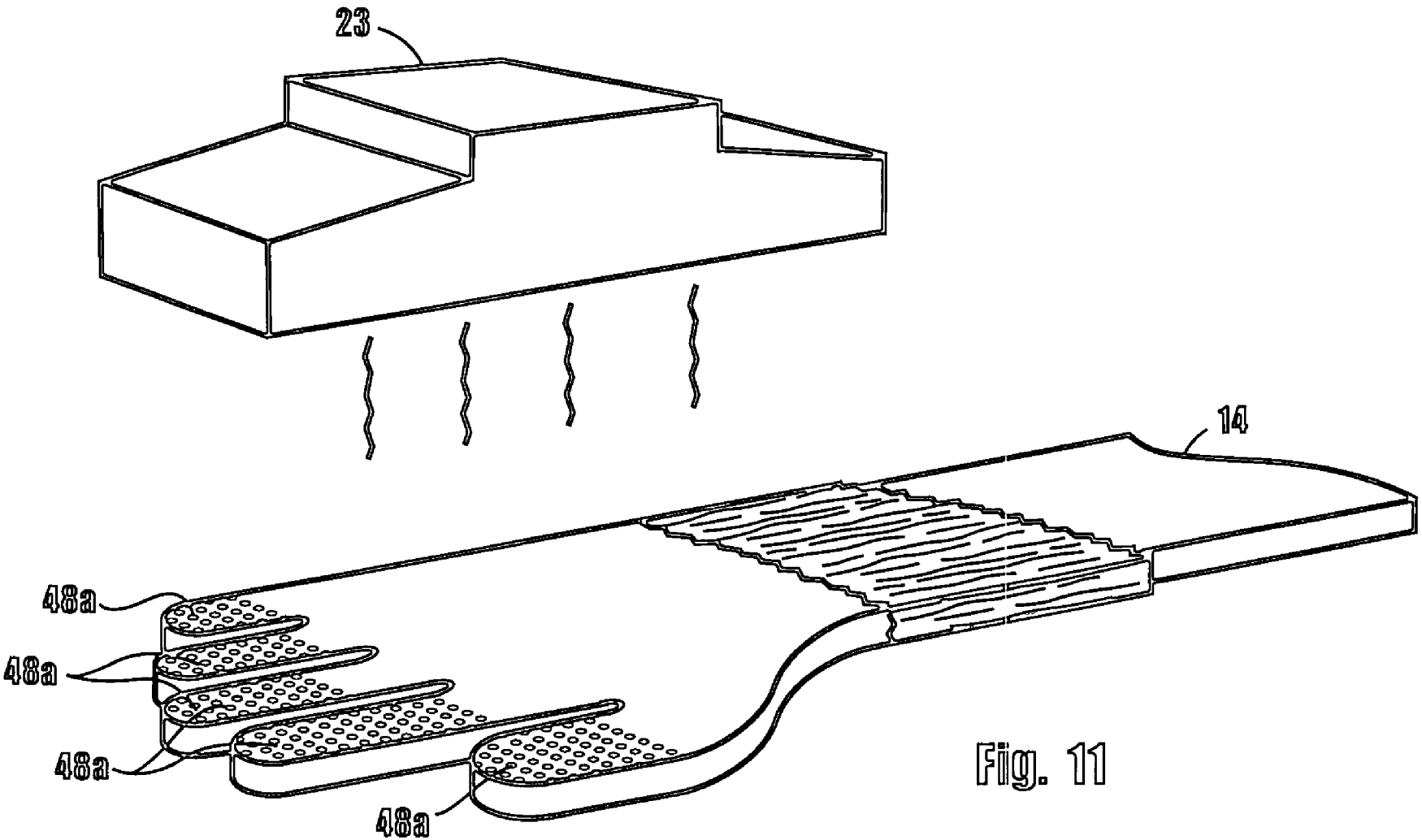
FIG. 11 is a generally perspective view, similar to FIG. 8, but showing the irradiation means of the apparatus of the invention superimposed over the second, coated surface of the alternate form of the glove of the invention.

Following the dot formation step to form the uncured second finger dot precursor, the vinyl dots 48*a* are suitably cured in the manner previously described by exposing the dots to a suitable radiation that is emitted from the radiation means 23 of the invention (see FIG. 11).

Figure 12:
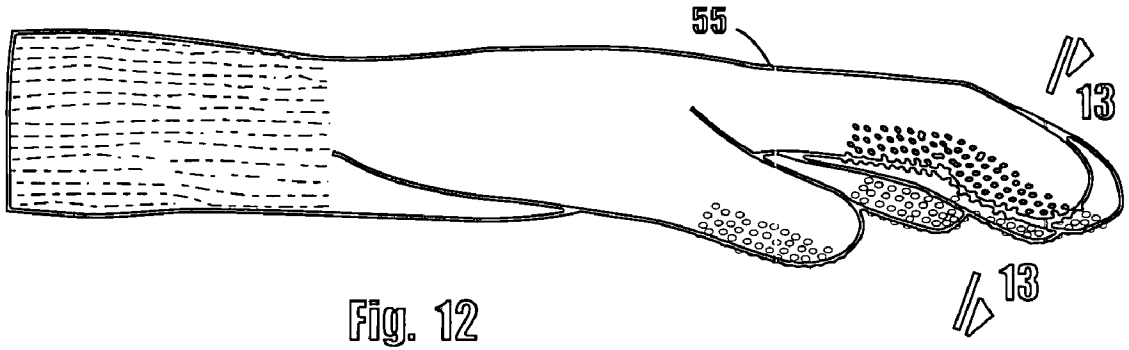
FIG. 12 is a generally perspective view of the alternate form of the glove of the invention having gripping surfaces on the finger portions of both the first and second sides of the glove.
Figure 13:
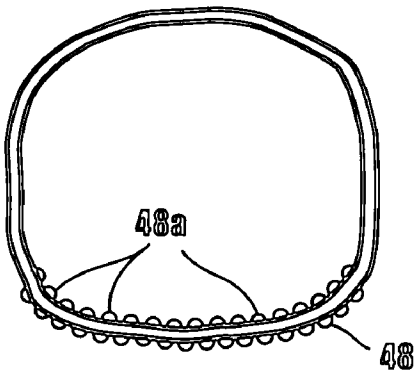
FIG. 13 is an enlarged cross-sectional view taken along lines 13—13 of FIG. 12.

Following the curing step of the second finger dot precursor, the glove, in which the finger portions thereof are now coated on both sides with the cured gripping dots, can be removed from the mandrel 14. When the printed glove 55 is removed from the form, the dots advantageously move closer together as the surface of the glove returns to its unstretched configuration. Following the curing step, the second cured finger dot precursor is removed from the mandrel and once again turned inside-out. The resulting glove 55, which uniquely has gripping dots on both the inside and outside surfaces of the finger portions of the glove, is depicted in FIG. 12 of the drawings (see also FIG. 13).

The unique grip dot pattern provided on the finger and thumb portions of the finished glove 55 provides improved finger gripping characteristics both when the glove is wet and when the glove is dry when compared to the grip obtainable from bare hands.

Figure 14:
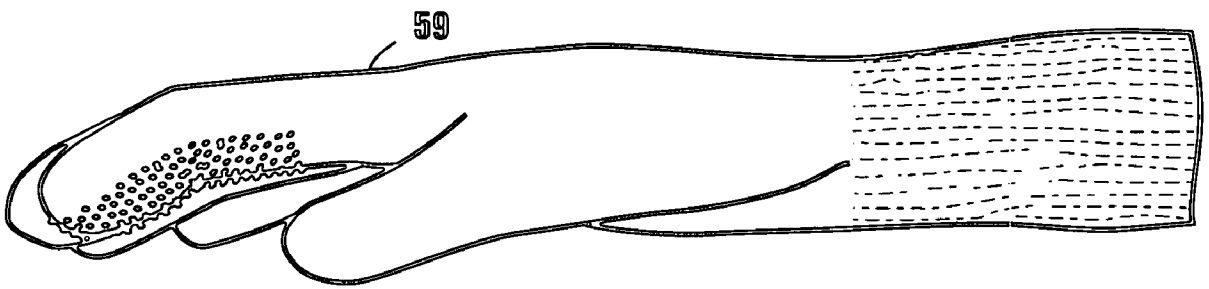
FIG. 14 is a generally perspective view of still another form of the glove of the invention having gripping surfaces only on the index finger portions of the first and second sides of the glove.

In certain instances, as for example the glove used primarily for shooting a firearm, it is advantageous to only coat the index or trigger finger of the glove using a mandrel in which only the finger portion is provided with apertures. The third alternate form of the glove 59 of the invention, which is illustrated in FIG. 14 of the drawings, has gripping dots only on the inside and outside surfaces of the trigger finger 60. This glove is ideally suited for use in firing firearms of various types since slippage of the trigger finger relative to the trigger of the firearm is substantially reduced.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A method of making a glove using an apparatus comprising a generally hand-shaped mandrel and a stencil member having a plurality of apertures therethrough, said method comprising the steps of:

(a) forming a generally hand-shaped glove having inner and outer surfaces, a palm surface, a thumb, and four fingers, including an index finger;

(b) placing said glove over the mandrel to form a glove having a first, generally planar surface;

(c) superimposing the stencil over said first surface of said glove;

(d) depositing a multiplicity of dots of a polymer emulsion on said first surface of said glove by forcing the emulsion through said apertures formed in said stencil to form an uncured first precursor;

(e) curing said polymer emulsion to form a first cured precursor;

(f) removing said first cured precursor from the mandrel, turning the first cured precursor inside-out to form an inside-out first cured precursor and placing said inside-out first cured precursor over the mandrel to form an inside-out first precursor having a second, generally planar surface;

(g) superimposing the stencil over said second generally planar surface of said inside-out first cured precursor;

(h) depositing a multiplicity of dots of a polymer emulsion on at least a portion of said second generally planar surface of said inside-out first cured precursor by forcing the emulsion through said apertures formed in said stencil to form an uncured second precursor;

(i) curing said polymer emulsion deposited on said inside-out first cured precursor to form a second cured precursor; and (j) removing said second cured precursor from said mandrel.

2. The method as described in claim 1 in which said multiplicity of dots of a polymer emulsion deposited on said inside-out first precursor are deposited only on the index finger of said inside-out first cured precursor.

3. The method as described in claim 1 in which said multiplicity of dots of a polymer emulsion deposited on said inside-out first precursor are deposited on the four fingers of said inside-out first cured precursor.

4. The method as described in claim 1 in which said multiplicity of dots of a polymer emulsion deposited on said inside-out first precursor are deposited on the four fingers and the thumb of said inside-out first cured precursor.

5. The method as described in claim 1 in which said multiplicity of dots of polymer emulsion deposited on said first surface of said glove are cured by an irradiation device for producing ultraviolet radiation.

6. The method as described in claim 1 in which said multiplicity of dots of polymer emulsion deposited on said first surface of said glove are cured by a heating device for heating said polymer emulsion.

7. The method as defined in claim 1 in which said polymer emulsion comprises a polyvinyl chloride emulsion.

8. A method of making a glove using an apparatus comprising a generally hand-shaped mandrel and first and second stencil members, each having a plurality of apertures therethrough, said method comprising the steps of:

(a) forming from a stretchable yarn, a generally hand-shaped, closely fitting stretchable glove having a starting size, a palm surface, a thumb, and four fingers, including an index finger;

(b) placing said glove over the mandrel to form a stretched glove having a first, generally planar surface;

(c) superimposing the first stencil over said first surface of said glove;

(d) depositing a multiplicity of dots of a liquid vinyl on at least a portion of said first surface of said glove by forcing the liquid vinyl through said apertures formed in said first stencil to form an uncured first precursor;

(e) curing said liquid vinyl to form a first cured precursor;

(f) removing said first cured precursor from the mandrel, turning the first cured precursor inside-out to form an inside-out first cured precursor having a plurality of finger portions and placing said inside-out first cured precursor over the mandrel to form an inside-out first precursor having a second, generally planar surface;

(g) superimposing the second stencil over said second generally planar surface of said inside-out first cured precursor;

(h) depositing a multiplicity of dots of a liquid vinyl on at least one of said plurality of fingers of said inside-out first cured precursor by forcing the liquid vinyl through said apertures formed in said second stencil to form an uncured second precursor;

(i) curing said liquid vinyl deposited on at least one of said plurality of fingers to form a second cured precursor; and (j) removing said second cured precursor from said mandrel.

9. The method as described in claim 8 in which said glove when placed upon said mandrel is stretched to approximately 20 to 30 percent of said starting size.

10. The method as described in claim 8 in which said multiplicity of dots of a liquid vinyl deposited on said inside-out first cured precursor are deposited only on one finger of said plurality of fingers of said inside-out first cured precursor.

11. The method as described in claim 8 in which said multiplicity of dots of a liquid vinyl deposited on said portion of said first surface of said glove cover an area of less than 25% of said portion of said first surface of said glove.

12. The method as described in claim 8 in which said stretchable yarn comprises synthetic fibers, which incorporate elastic filaments.

13. The method as described in claim 8 in which said liquid vinyl deposited on said first surface of said glove is cured by a radiation device for irradiating said liquid vinyl.

14. A method of making a glove using an apparatus comprising a generally hand-shaped mandrel and first and second stencil members, each having a plurality of apertures therethrough, said method comprising the steps of:

(a) knitting, from a yarn that incorporates elastic filaments, a generally hand-shaped, closely-fitting stretchable glove having an inside surface and an outside surface, each of said surfaces having a palm surface, a thumb surface, and four fingers each having a surface, including an index finger having a surface;

(b) placing said stretchable glove over the mandrel to form a stretched glove having a first, generally planar surface;

(c) superimposing the first stencil over said first surface of said glove;

(d) depositing a multiplicity of dots of a liquid vinyl on at least a portion of said first surface of said glove by forcing the liquid vinyl through said apertures formed in said first stencil to form an uncured first precursor;

(e) curing said liquid vinyl to form a first cured precursor;

(f) removing said first cured precursor from the mandrel, turning the first cured precursor inside-out to form an inside-out first cured precursor wherein the inside surface is exposed and placing said inside-out first cured precursor over the mandrel to form an inside-out first precursor having a second, generally planar surface;

(g) superimposing the second stencil over said second generally planar surface of said inside-out first cured precursor;

(h) depositing a multiplicity of dots of a liquid vinyl on at least a portion of said inside-out first cured precursor by forcing the liquid vinyl through said apertures formed in said second stencil to form an uncured second precursor;

(i) curing said liquid vinyl deposited on at least a portion of said inside-out first cured precursor to form a second cured precursor;

(j) removing said second cured precursor from said mandrel; and (k) turning said second cured precursor inside-out to form a finished glove.

15. The method as described in claim 14 in which said multiplicity of dots of a liquid vinyl deposited on said inside-out first precursor are deposited only on the index finger surface of said inside-out first cured precursor.

16. The method as described in claim 14 in which said multiplicity of dots of a liquid vinyl deposited on said inside-out first precursor are deposited on the surfaces of the four fingers of said inside-out first cured precursor.

17. The method as described in claim 14 in which said multiplicity of dots of a liquid vinyl deposited on said inside-out first precursor are deposited on the surfaces of the four fingers and the thumb of said inside-out first cured precursor.

18. The method as described in claim 14 in which said multiplicity of dots of liquid vinyl deposited on said inside-out first precursor are deposited on the palm surface of said outside surface of said stretchable glove.

19. The method as described in claim 14 in which said multiplicity of dots of liquid vinyl deposited on said inside-out first precursor are deposited on the surfaces of the finger portions of said outside surface of said stretchable glove.

20. The method as described in claim 14 in which said multiplicity of dots of liquid vinyl deposited on said inside-out first precursor are deposited only on the surface of the index finger portion of said outside surface of said stretchable glove.

* * * * *